United States Patent [19]

Choi

[11] 4,141,794

[45] Feb. 27, 1979

[54] GRID-WALL PYROLYSIS REACTOR

[75] Inventor: Charles K. Choi, Fullerton, Calif.

[73] Assignee: Occidental Petroleum Corporation, Los Angeles, Calif.

[21] Appl. No.: 834,724

[22] Filed: Sep. 19, 1977

Related U.S. Application Data

[63] Continuation-in-part of Ser. No. 700,050, now abandoned.

[51] Int. Cl.[2] ..... C10B 49/16; C10B 53/06

[52] U.S. Cl. ..... 201/12; 48/210; 201/21; 201/22; 201/25; 201/28; 201/30; 201/32; 202/99; 208/8; 208/11 R

[58] Field of Search ..... 201/7, 8, 10, 12, 21–23, 201/25, 28, 30–32, 34; 202/99, 108, 120, 121; 48/210; 208/8, 11 R

[56] References Cited

U.S. PATENT DOCUMENTS

| | | | |
|---|---|---|---|
| 1,079,093 | 11/1913 | Aylsworth et al. | 202/108 |
| 1,586,131 | 5/1926 | Trumble | 202/99 |
| 1,702,699 | 2/1929 | Lutz | 202/121 |
| 2,448,223 | 8/1948 | Lantz | 202/99 X |
| 2,607,666 | 8/1952 | Martin | 48/62 R |
| 2,825,679 | 3/1958 | Baum | 202/108 X |
| 3,150,063 | 9/1964 | Comte | 202/120 |
| 3,655,518 | 4/1972 | Schmalfeld et al. | 201/12 X |
| 3,736,233 | 5/1973 | Sass et al. | 201/22 X |
| 3,855,070 | 12/1974 | Squires | 208/8 X |

FOREIGN PATENT DOCUMENTS

| | | | |
|---|---|---|---|
| 158394 | 2/1921 | United Kingdom | 202/108 |

*Primary Examiner*—Joseph Scovronek
*Attorney, Agent, or Firm*—Christie, Parker & Hale

[57] ABSTRACT

A carbonaceous material is pyrolyzed by introducing the carbonaceous material to a fast fluidized bed contained by a perforated wall and introducing a particulate source of heat through the perforations of the wall at an angle inclined to the path of travel of the carbonaceous material. The radially introduced particulate source of heat prevents carbonaceous material from caking on the walls of the bed.

29 Claims, 4 Drawing Figures

GRID-WALL PYROLYSIS REACTOR

CROSS-REFERENCE

This application is a continuation-in-part application of U.S. patent application Ser. No. 700,050 filed on June 25, 1976, now abandoned.

BACKGROUND OF THE INVENTION

Due to the increasing scarcity of fluid fossil fuels such as oil and natural gas, much attention is being directed towards converting solid carbonaceous materials such as coal, oil shale, and solid waste to liquid and gaseous hydrocarbons by pyrolyzing the solid carbonaceous material. Typically, pyrolysis occurs under nonoxidizing conditions in the presence of a particulate source of heat.

In the past, pyrolysis has been carried out in reactors with long pyrolysis times. These reactors provide a yield of middle boiling hydrocarbons, i.e., $C_5$ hydrocarbons to hydrocarbons having an end point of about 950° F., less than desired. Their loss has been attributed to protracted effective pyrolysis times which result in thermal cracking of such hydrocarbons.

Tubular reactors providing a short pyrolysis time result in increased yield of middle distillates. However, a disadvantage of using tubular reactors for pyrolysis is a caking or agglomeration problem. Experience with agglomerative coals, particularly Eastern United States coals, indicates that these coals pass through a "tacky" stage during which the coal particles have a tendency to agglomerate in a tubular reactor, especially along the walls of the reactor.

A need exists therefore for a more efficient pyrolysis process and a more efficient pyrolysis reactor which maximizes the yield of the middle boiling hydrocarbons which are useful for the production of gasoline, diesel fuel, heating fuel, and the like, and which prevent coal from agglomerating along the walls of the reactor.

SUMMARY OF THE INVENTION

According to the present invention, there is provided a process for the pyrolysis of carbonaceous materials and an apparatus used therefor with the above features.

In the process of this invention, a solid carbonaceous material contained in a carrier gas which is nondeleteriously reactive with respect to pyrolysis products is introduced to the base of a fast fluidized bed maintained within a vertically disposed perforated wall chamber of a pyrolysis reaction zone. Simultaneously, there is introduced into the fast fluidized bed a pressurized particulate solid source of heat contained in a fluidizing gas which is nondeleteriously reactive with respect to pyrolysis products through perforations at an angle inclined to the path of travel of the carbonaceous material in the fast fluidized bed. The particulate solid source of heat passes through the perforations in the wall at a velocity sufficient to penetrate and initiate pyrolysis of the carbonaceous material. The introduced quantity of particulate source of heat is sufficient to raise the carbonaceous material to a pyrolysis temperature of at least about 600° F.

The pyrolysis of the carbonaceous material yields a particulate carbon containing solids residue and a pyrolytic vapor containing hydrocarbons.

Preferably, the particulate source of heat is introduced inclined at an angle from about 70° to about 90°, and more preferably, normal to the path of the carbonaceous material in the fast fluidized bed to ensure complete penetration of the solid carbonaceous material.

A stream containing a gaseous mixture of the carrier gas and pyrolytic vapor and an entrained solids mixture including particulate source of heat and carbon containing solids residue are withdrawn through an outlet above the fast fluidized bed. The gaseous mixture is separated from the solids mixture and the hydrocarbons are then recovered from the gaseous mixture.

In the process of this invention, pyrolysis can occur at a temperature from about 600° to about 2000° F. Short reaction times and low temperatures in the fast fluidized bed enhance formation of middle distillate hydrocarbons, i.e., hydrocarbons in the range of $C_5$ hydrocarbons to hydrocarbons having an end point of 950° F. As a consequence, it is preferred to conduct pyrolysis at reaction times of less than about 15 seconds, and more preferably from about 0.1 to about 5 seconds, and at a temperature from about 900° to about 1400° F.

To achieve pyrolysis, the solid particulate source of heat generally is introduced to the fast fluidized bed at a temperature from about 100° to about 500° F. higher than the pyrolysis temperature to be achieved. The weight ratio of the particulate source of heat to the carbonaceous feed ranges from about 2:1 to about 20:1.

The pressure across the perforations to the fast fluidized bed preferably is at least about 3 psi to ensure a steady flow of the particulate source of heat. The higher the pressure drop the more consistent the flow of the particulate source of heat. However, the increased cost of maintaining pressure drops greater than about 7 psi is not warranted by the improved results. The velocity of the particles exiting from the grid wall is preferably greater than about 30 feet per second to ensure adequate penetration of the carbonaceous material by the particulate source of heat, and more preferably greater than about 50 feet per second. However, when char is the particulate source of heat, velocity preferably is limited to about 70 feet per second because of the friable nature of the char.

In the process of this invention, a portion of the carbon containing solid residue of pyrolysis not fluidizable in the fast fluidized bed is collected in a stripping zone of the pyrolysis reaction reaction. The stripping zone is below and communicates with the fast fluidized bed. In order to obtain improved yields, hydrocarbons preferably are stripped from particles in the stripping zone with a stripping gas which is nondeleteriously reactive with respect to pyrolysis products. This stripping gas passes through the stripping zone and into the fast fluidized bed and out through the outlet above the fast fluidized bed for recovery of the hydrocarbons removed from the particles in the stripping zone.

Even higher yields are obtained by stripping hydrocarbons from the solids mixture separated in the separation zone. After hydrocarbons are stripped from the separated mixture, the carbon containing solids residue may be at least partially oxidized in a combustion zone to form the particulate source of heat for feed to the pyrolysis reaction zone.

The pyrolysis reactor employed to carry out the process of this invention comprises an inner chamber peripherally enclosed by a substantially vertically oriented perforated wall. The chamber has a solids inlet at its base and an outlet at the opposed end. Preferably the outlet above the inner chamber is a vertically oriented hood which tapers inwardly away from the chamber to minimize the residence time of the pyrolytic vapors in the reactor. For ease of construction, the perforated wall preferably is a vertically oriented cylindrical tube. Outside of the wall, there is an outer chamber along at least a portion of the periphery of the perforated wall. The outer chamber has a solids inlet at its base. Means are provided for introducing fluidized particulate carbonaceous material to undergo pyrolysis to the solids inlet of the inner chamber. In addition, means are provided for introducing a stream of particulate source of heat for pyrolysis to the outer chamber and through the perforations of the vertically oriented wall at a velocity sufficient to initiate pyrolysis of the carbonaceous material in the inner chamber.

Where it is desired to strip hydrocarbons from the particulate carbon containing solids residue not fluidized in the fast fluidized bed, a stripping chamber is provided below the inner chamber as well as means for passing a stripping gas through the stripping chamber. Outlet means are provided at the base of the pyrolysis reactor for withdrawing stripped particles from the stripping chamber.

Means connecting the outlet above the fast fluidized bed to means for separating the gaseous mixture of the carrier gas and pyrolytic vapor from the entrained solids mixture, and when desired, means for stripping hydrocarbons from the separated entrained solids mixture are provided.

This process and pyrolysis reactor resolve the problems associated with prior art reactors discussed above. Because the carbonaceous material and hot solid particles are injected into a fast fluidized bed where heat transfer and the pyrolysis reaction take place within a short period of time, increased yield of the middle boiling hydrocarbons results. Because the particulate source of heat is introduced radially into the fast fluidized bed through perforations in the wall surrounding the fast fluidized bed, carbonaceous material agglomeration on the wall is prevented. These and other features, aspects and advantages of the present invention will become more apparent with reference to the following drawings, detailed description of the invention, and appended claims.

DRAWINGS

DESCRIPTION OF THE INVENTION

Figures 1, 2, 3, 4:
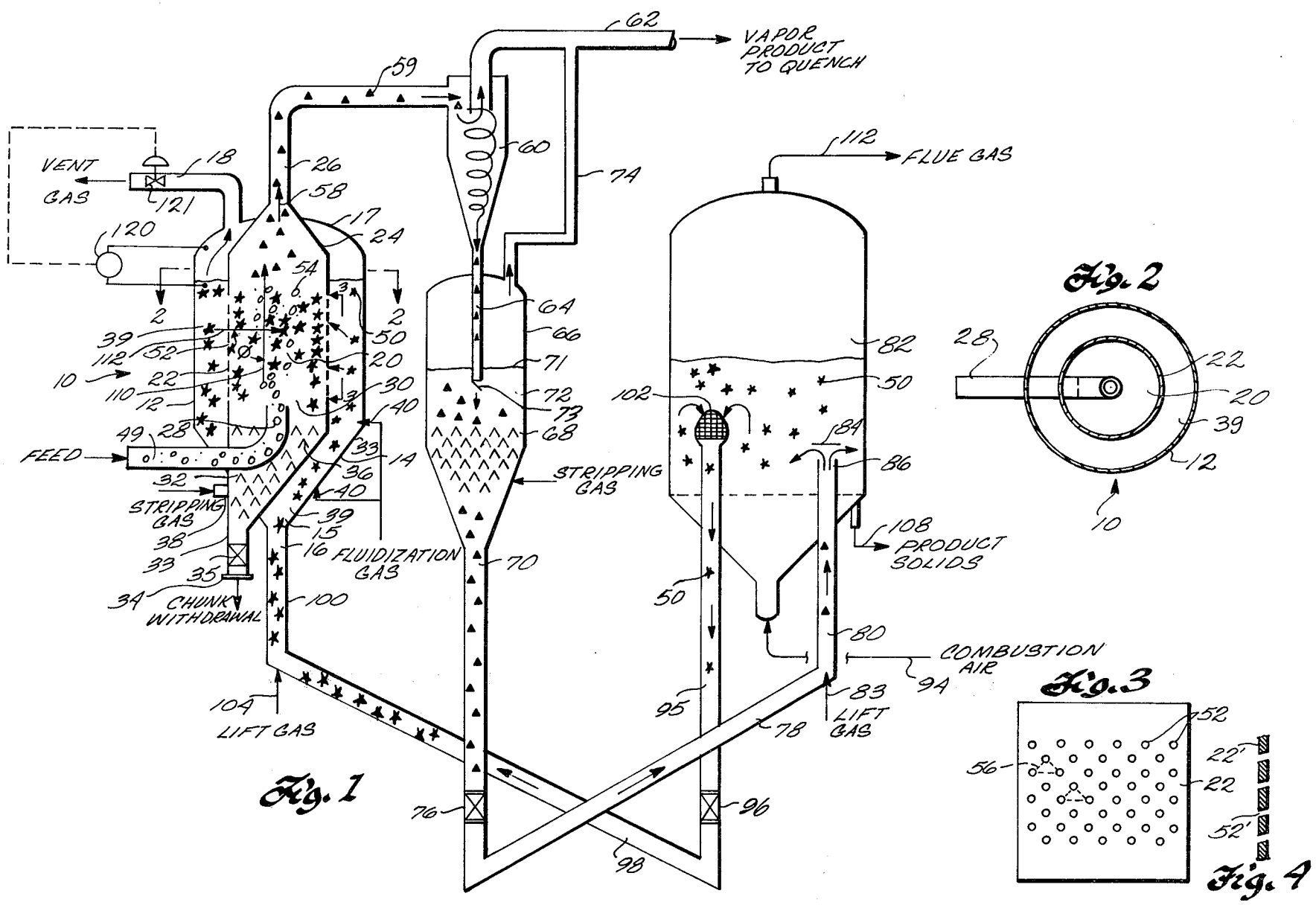
FIG. 1 illustrates in section the overall apparatus employed to carry out the process of this invention.
FIG. 2 is a top view in section of the pyrolysis reactor along line 2—2 in FIG. 1.
FIG. 3 is a view of the pyrolysis reactor along line 3—3 in FIG. 1.
FIG. 4 is a view in section of a vertical perforated wall along the periphery of a fast fluidized bed.

According to the present invention, there is provided a process and an apparatus for the pyrolysis of solid carbonaceous materials which can be used to maximize the yield of middle distillate hydrocarbons by short pyrolysis contact times and prevent agglomeration of the carbonaceous material.

The carbonaceous materials which are pyrolyzed in accordance with the present invention include solids such as tar sands, oil shale, the organic portion of solid waste, nonagglomerative and especially agglomerative coals, and the like, as well as mixtures thereof.

Referring to the Drawings, a pyrolysis reactor 10 comprises a vertically oriented cylindrical main outer body 12 connected to an inverted conical section 14 below and axially aligned with the main body 12. At the apex 15 of the conical section 14 is an inlet 16 for a particulate solid source of heat. The cylindrical body has a dome top 17 with a gas outlet 18 at the top.

There is a fast fluidized bed 20 maintained within an inner chamber of the pyrolysis reactor 10 peripherally enclosed by a perforated substantially vertically oriented wall 22 along its vertical edges and a vertically oriented hood or conical collector 24 which necks down inwardly away from the inner chamber to form an outlet 26 above the bed 20. An inlet tube 28 for discharging a carbonaceous material contained in a carrier gas upwardly into the fluidized bed is provided at the base 30 of the fluidized bed. Below the fluidized bed in the bottom conical section 14 of the pyrolysis reactor 10 is a stripping chamber 32, the wall 33 of which is an unperforated extension of the perforated wall 22. The stripping chamber 32 necks down to form an outlet 34 which extends out through the bottom of the pyrolysis reaction zone 10 for withdrawal of particles too heavy to be fluidized in the fast fluidized bed. A slide valve 35 is provided in the solids removal outlet 34 to control the removal of the stripped solids. Preferably, the stripping zone 32 is provided with baffles such as triangular shed baffles 36 and an inlet 38 at the bottom of the stripping chamber for stripping gas.

An outer chamber 39 along the outer periphery of the fast fluidized bed between the walls 22, 33 around the fast fluidized bed 20 and the stripping chamber 32, respectively, and the main body 12 and its bottom conical section 14 is a fluidized chamber for the particulate solid source of heat. Inlets 40 are provided for a fluidizing gas into the bottom of the fluidizing chamber 39.

A carbonaceous material contained in a carrier gas is introduced through inlet 28 upwardly into the fast fluidized bed 20. The carrier gas is nondeleteriously reactive with respect to the products of pyrolysis and may serve as a diluent to minimize pyrolysis contact time and to dilute the carbonaceous material to prevent self-agglomeration. As used herein, by a "nondeleteriously reactive" gas there is meant a gas stream which is essentially free of free oxygen. Although constituents of the gas may react with pyrolysis products to upgrade their value, to be avoided are constituents which degrade pyrolysis products. The carrier gas may, for instance, be the off-gas product of pyrolysis, steam which will react under suitable conditions with char or coke formed from pyrolysis to yield by a water-gas shift reaction, hydrogen which serves to react with and stabilize unsaturates in the products of pyrolysis, any desired inert gas, or mixtures thereof.

As used herein, the term "fast fluidized bed" is used as it is used in column 6, lines 11 through 17 of U.S. Pat. No. 3,855,070 issued to Squires, incorporated herein by reference. The advantage of using a fast fluidized bed is that intimate mixing can be obtained between the carbonaceous material and the source of heat used to heat the carbonaceous material to pyrolysis temperature. The solid phase in a fluidized bed appears generally to be discontinuous, taking the form of falling streams and ribbons and the gas appears to flow upwards in between the solid particles. The gas conveys solids upwards and much refluxing of solids occurs. There is a marked gradient in solid density between the bottom and top of the fluidized bed 20, the density being greater at the bottom. The lighter solid particles are carried upward out of the fluidized bed by the upwardly flowing gas while the heavier denser particles tend to drop downwards into the stripping chamber 32 below the fluidized bed 20.

In order to obtain a fast fluidized bed, gas velocities of from about 5 to 50 feet per second are required in the bed. Since the cross-sectional area of the inlet 28 for the carbonaceous material is less than the cross-sectional area of the fluidized bed, it is necessary that the velocities in the inlet 28 be higher than the velocities in the fast fluidized bed.

The carbonaceous material may be treated before it is fed to the fast fluidized bed by processes such as removal of inorganic fractions by magnetic separation and classification, particularly in the case of municipal solid waste. The carbonaceous material also can be dried to reduce its moisture content. The solid carbonaceous material usually is comminuted to increase the surface area available for the pyrolysis reaction.

Simultaneously with the introduction of the carbonaceous material, there is introduced a particulate source of heat and its carrier gas into the fluidizing chamber 39 through the inlet 16 at the bottom of the pyrolysis reaction zone 10. A fluidizing gas which is nondeleteriously reactive with respect to pyrolysis products is injected through inlets 40 into the bottom of the fluidizing chamber, thereby fluidizing the particulate source of heat. The particles of the particulate source of heat, which are marked by the stars 50 in FIG. 1, pass through the perforations 52 in the perforated wall 22 surrounding the fast fluidized bed 20.

Because the particulate solid source of heat radially enters the fast fluidized bed 20 at an angle inclined, and preferably substantially normal, to the path of travel of the carbonaceous material marked by the circles 54, it penetrates the path of the carbonaceous material. This penetration initiates heat transfer from the particulate solid source of heat to the carbonaceous material, instantaneously causing pyrolysis which is a combination of vaporization and cracking reactions. As the vaporization and cracking reactions occur, condensible and noncondensible hydrocarbons are generated from the carbonaceous material with an attendant production of a carbon containing solid residue such as coke or char. An effective pyrolysis time in the fast fluidized bed is less than about 15 seconds, and preferably from about 0.1 to about 5 seconds to maximize yield of the middle distillates. The term "pyrolysis time" as used herein means the average residence time of the carrier gas in the fast fluidized bed.

The angle at which the particulate solid source of heat is inclined to the path of travel in the carbonaceous material and the fast fluidized bed is represented in FIG. 1 by the angle $\phi$ between line 110 representing the path of travel of the carbonaceous material in the fast fluidized bed and line 112 representing the path of travel of the particulate source of heat through the perforations. Preferably, angle $\phi$ is between about 70° and about 90° because at angles less than about 70° inadequate penetration of the carbonaceous material may result and at angles greater than about 90° the particulate source of heat interferes with the upward motion of the solid carbonaceous material and the carbon containing solid residue in the fast fluidized bed. Preferably, the particulate source of heat is introduced perpendicularly to the path of travel of the carbonaceous material to ensure complete penetration of the carbonaceous material by the particulate source of heat.

The angle $\phi$ can be varied by tilting the wall 22 away from the vertical, by forming the perforations 52 in the wall at an angle inclined to the horizontal as shown in FIG. 4, and by a combination of these two methods. The preferred method is to form the perforations tilted from the normal because it is more expensive to construct a draft tube with sloping walls than a cylindrical draft tube. In FIG. 4, the perforations 52' in the wall 22' are tilted at an angle of about 15° to the horizontal so that the particulate source of heat is introduced to the fast fluidized bed at an angle of about 75° inclined to the path of travel of the carbonaceous material.

The hot particulate solid is supplied at a rate and a temperature consonant with maintaining a temperature in the fast fluidized bed suitable for pyrolysis. Pyrolysis initiates at about 600° F. and may be carried out at temperatures above 2000° F. The maximum temperature of pyrolysis is limited to a temperature lower than the temperature at which the inorganic portion of the particulate source of heat softens with resultant slag formation. Preferably pyrolysis is conducted at a temperature from about 900° to about 1400° F. to maximize the yield of middle boiling point hydrocarbons. Higher temperatures, by contrast, enhance gasification reactions.

Depending upon pyrolysis temperature, normally from about 2 to about 20 pounds of particulate solid source of heat are fed per pound of carbonaceous material entering the fast fluidized bed 20. At these ratios, the particulate source of heat is introduced to the fast fluidized bed at a temperature from about 100° to about 500° F. above the desired pyrolysis temperature. The solids employed may be solids provided external to the process such as sand or the solid product resulting from pyrolysis of the carbonaceous material, such as char or coke, or, in the same instance of municipal solid waste, the glass-like inorganic residue resulting from the decarbonization of the solid residue of pyrolysis. The particulate source of heat serves to prevent agglomeration of the carbonaceous material and to provide the heat required for the endothermic pyrolysis reaction.

The amount of gas employed to transport the solid carbonaceous material and the particulate source of heat and to fluidize the particulate source of heat is sufficient to maintain transport of the materials and avoid plugging, and is normally in excess of that amount to dilute the solids materials and minimize pyrolysis contact time. Normally the solids content of a combined stream of the carbonaceous materials plus the particulate source of heat to gas is from about 0.1 to about 10% by volume based on the total volume of the stream.

Sufficient pressure drop must be maintained across the perforations leading from the fluidizing chamber into the fast fluidized bed to ensure a steady flow of the particulate source of heat without surges which can upset the pyrolysis reaction. Therefore, preferably a pressure drop of at least about 3 psi is maintained across the perforations. However, the benefits obtained by pressure drops greater than about 7 psi usually do not warrant the increased operating and capital costs associated with the higher capacity compressors required to obtain the higher pressure drops. Therefore, it is preferred that the pressure drop across the perforations be maintained from about 3 to about 7 psi.

Preferably the particulate source of heat exits the perforations with sufficient momentum and velocity to penetrate at least about halfway across the entire fast fluidized bed for intimate contact between the particulate source of heat and all of the solid carbonaceous material. Therefore it is preferred that the particulate source of heat exit from the perforations at greater than about 30 feet per second, and more preferably greater than about 50 feet per second. However, the momemtum and velocity of the particulate source of heat are maintained sufficiently low that the particulate source of heat does not penetrate across the entire fluidized bed. If the particulate source of heat penetrated across the entire fluidized bed, solid carbonaceous material could be carried along, with resultant caking on the reactor wall.

A portion of the particulate source of heat does not pass through the perforations 52 in the perforated wall 22 at the first try, but instead impinges against the wall. In the case of char and other friable materials which may be used as the particulate source of heat, at velocities greater than about 70 feet per second, these materials pulverize against the perforated wall. Therefore it is preferred that the exit velocity of the particulate source of heat from the perforations be maintained at less than about 70 feet per second in the case of a friable material.

Preferably the perforations in the perforated wall are circular for ease of fabrication and their diameter is from about ½ to about 2½ inches. At diameters less than about ½ inch there is a tendency for the holes to plug. At diameters greater than about 2½ inches, since the area and the pressure drop across the perforated wall is proportional to the square of the diameter of the holes, the total number of holes required decreases to such a degree the particulate source of heat particles do not uniformly penetrate the fast fluidized bed. Instead, there are localized areas of high concentration of particulate source of heat particles in the vicinity of the perforations.

FIG. 3 shows a perforated wall 22 where the perforations 52 are uniformly spaced apart tubes which in cross-section appear as circles. A uniformly perforated wall or grid wall as shown in FIG. 3 is preferred to obtain uniform penetration of the fast fluidized bed with the hot particulate source of heat and to maintain a uniform pressure drop across the wall. As shown in FIG. 3, the perforations can be placed to form the apices of a plurality of equilateral triangles shown by phantom lines 56.

However, it is contemplated within the scope of this invention to use perforations which are not uniform in cross-section such as ovals, squares, rectangles, irregular shapes, and mixtures thereof. In addition it is not necessary for the perforations to be uniformly sized or uniformly spaced apart as shown in FIG. 3. For example, there could be more perforations and/or larger perforations towards the bottom of the fast fluidized bed to allow more of the hot particulate source of heat to contact the carbonaceous material entering through the feed inlet 28, thereby ensuring that all the carbonaceous material is immediately contacted by a hot particulate particle.

The percentage of the total surface area of the vertical wall consisting of perforations is determined from the mass flow rate of the particulate source of heat and the desired discharge velocity of the particulate source of heat from the perforations. The total number of holes is determined by selecting the diameter of the perforations, i.e., preferably from about ½ to about 2½ inches, and dividing the cross-sectional area of each hole into the total area required. The void area of the wall is adjusted within the range of the preferred velocities of about 30 to about 70 feet per second to obtain a desired pressure drop of from about 3 to about 7 psi.

A lever controller 120 and a control valve 121 in the vent gas outlet line 18 are provided to maintain the level of the hot particulate source of heat in the fluidizing chamber above the uppermost perforation through the wall 22. If the level of the fluidized bed were to drop below the uppermost perforation, an excessive amount of fluidizing gas would pass into the fast fluidized bed zone through the exposed perforations, thereby undesirably diluting the pyrolytic vapor. As the level in the fluidized bed drops, the controller 120 causes the control valve 121 to open to reduce the pressure in the fluidizing chamber, and thereby reduce the amount of particulate source of heat passing through the perforations into the fast fluidized bed. Conversely, as the level in the fluidized bed rises, the control valve closes to raise the pressure in the fluidizing chamber to cause the particulate source of heat to pass into the fast fluidized bed.

Fluidization gas which does not flow into the fast fluidized bed 20 along with the hot particulate source of heat through the perforations is withdrawn through the vent 18 projecting out of the domed top 17 of the pyrolysis reactor 10. The vented gas can be recovered for its heating value, or it may be cycled back to the pyrolysis reaction zone 10 as fluidization or carrier gas. When the fluidization gas contains steam in order to produce hydrogen by the water-gas shift reaction by reacting with the hot particulate source of heat, gaseous products of this reaction, which include carbon monoxide and hydrogen, are also vented through the gas vent 18.

At the bottom of the pyrolysis reactor below the fast fluidized bed, solids not fluidizable in the fast fluidized bed 20 or fluidizing chamber 39 are collected. These solids include particulate source of heat, carbon containing solid residue, and carbonaceous material not adequately comminuted before feed to the pyrolysis reactor. These particles are collected in the stripping zone 32 which preferably has baffles such as triangular shed type baffles 36, and contacted with a stripping gas which is nondeleteriously reactive with respect to pyrolysis products to remove hydrocarbons which may have accumulated on the surface of these particles. The stripping gas enters through inlet 38. The baffles are provided to yield an even distribution of the stripping gas throughout the stripping chamber. The stripping gas flows upwards through the stripping chamber into the fast fluidized bed and exits the pyrolysis reactor 10 through the outlet 26 at the top of the pyrolysis reactor. Solids are removed from the stripping chamber as required via the slide valve 35 and outlet 34.

A stream 58 exiting from the pyrolysis reaction zone 10 through the outlet 26 above the fast fluidized bed 20 contains pyrolytic vapors comprising hydrocarbons, carrier gases, and undesirable components such as hydrogen sulfude which may be generated in the pyrolysis reaction, as well as an entrained solids mixture including particulate source of heat and carbon containing solids residue. The entrained solids are represented by triangles 59 in FIG. 1. The volatilized hydrocarbons produced by pyrolysis consist of condensible hydrocarbons which may be recovered by simply contacting the volatilized hydrocarbons with a condensation means, and noncondensible hydrocarbons such as methane and other hydrocarbon gases which are not recoverable by ordinary condensation means.

The gases in line 26 are separated from the entrained solids in a gas separation zone such as cyclone 60. In order to obtain an efficient separation in the cyclone, the gases and entrained solids in line 26 generally enter the cyclone at a velocity of from about 60 to about 200 feet per second. This velocity is achieved by a large reduction in cross-sectional area for gas flow due to the necking down of the hood 24 above the fast fluidized bed to the comparatively small diameter of line 26. The necking down of the hood also serves to minimize the residence time of the volatilized hydrocarbons in the pyrolysis reactor to minimize degradation of the hydrocarbon product by cracking.

Gases separated in the cyclone 60 are withdrawn from the top of the cyclone through line 62 and transferred to a quench and recovery operation (not shown). In the quench operation the gases are contacted with a quench fluid to reduce gas temperature at least below pyrolysis and cracking temperature to prevent further cracking reactions from occurring. A portion of the heavier hydrocarbons formed in the pyrolysis reaction may be employed as the quench fluid. Condensible volatilized hydrocarbons are then separated and recovered by conventional separation and recovery means such as venturi scrubbers, indirect heat exchangers, wash towers, and the like. The undesirable gaseous product can be removed from the uncondensible hydrocarbons by conventional means such as chemical scrubbing. The remaining uncondensed hydrocarbons can be sold as a product gas and can be utilized as fluidization gas and carrier gas for carrying the carbonaceous material and the particulate source of heat to the pyrolysis reaction zone 10.

The entrained solids which are separated in the cyclone 60 drop through a dipleg 64 of the cyclone into a stripping vessel 66 having baffles such as triangular shed type baffles 68 above its bottom outlet 70. The dipleg discharges the entrained solids mixture below the top surface 71 of a bed 72 of the solids maintained in a mixed condition and in at least a semifluidized state by a stripping gas. A flap 73 on dipleg 64 prevents back flow of the stripping gas into the cyclone. Rather, the stripping gas exits the separator through the top and passes via line 74 into line 62 carrying the pyrolytic vapors to the quench and recovery operation. The stripping gas serves to remove hydrocarbon oils which result from pyrolysis from the surface of the particles.

The particulate source of heat and carbon containing solid residue of pyrolysis are passed from line 70 at the bottom of the stripper through slide valve 76 and transported along an angle riser 78 into vertical riser 80 to a combustion zone 82. A transport or lift gas stream 83 is used to carry the solids through line 80 into the combustion vessel 82. There is a deflector 84 above the outlet 86 from line 80 to uniformly distribute the solids into the combustion vessel 82.

In the combustion zone, the solids are at least partially oxidized in the presence of a source of oxygen such as combustion air stream 94 to provide the particulate source of heat for the pyrolysis reaction. Due to this exothermic oxidation reaction, the combustion zone is maintained at a temperature consonant with the operating temperature of the fast fluidized bed, and generally from about 100° to about 500° F. above the pyrolysis temperature.

A flue gas stream 112 is withdrawn from the top of the combustion vessel. The stream contains the inert constituents of the source of oxygen such as nitrogen in the case of air, the products of combustion such as carbon dioxide and carbon monoxide, and the lift gas. This flue gas stream 112 may be oxidized to recover its heating value.

As required, the particulate source of heat represented by stars 50 in FIG. 1 is passed down through standpipe 95, slide valve 96, angle riser 98, to a vertical riser 100 for feed to the fluidizing chamber 39. There is a screen 102 at the top of the standpipe 95 to prevent large particles from being carried into the fluidizing chamber where they may plug up the perforations in the vertical wall. A transport or lift gas stream 104 which is nondeleteriously reactive with respect to pyrolysis products is used to convey the particulate source of heat to the pyrolysis reactor 10. Excess solids in the combustion zone which represent the net solid product of the pyrolysis reaction are withdrawn from the combustion vessel through line 108.

The process and apparatus of this invention are particularly useful for agglomerative coals because caking of the coal is prevented by fast moving hot solid particles passing through the perforations in the reactor wall. Also, self-agglomeration of the coal particles is prevented because there is rapid and thorough mixing between the feed coal and the large amount of heat carrier particles utilized in the fast fluidized bed. Caking on the conical collector 24 above the fast fluidized bed does not occur with agglomerative coals because the coal particles pass through the tacky state in the fast fluidized bed before impinging on the collector. Furthermore, this invention results in high yields of middle distillate hydrocarbons from coal because of the short residence time in the fast fluidized bed of the pyrolysis reactor.

Although the process and apparatus of this invention are described in terms of certain embodiments thereof, other embodiments of this invention are obvious to those skilled in the art. For example, hydrogen gas can be added to the pyrolysis reactor for hydrogenating the volatilized hydrocarbons resulting from the pyrolysis of the carbonaceous material to upgrade their value. Because of variations such as these, the spirit and scope of the appended claims should not necessarily be limited to the description of the embodiments described above.

What is claimed is:

1. In a process for the pyrolysis of solid carbonaceous material in which the carbonaceous material is pyrolyzed by heat transfer thereto from a high temperature, particulate solid source of heat to yield as products of pyrolysis, a pyrolytic vapor and a particulate carbon containing solid residue, an improved method of achieving pyrolysis comprising:

(a) introducing to the base of a fast fluidized bed maintained within a vertically disposed perforated wall chamber of a pyrolysis reaction zone a flow of carbonaceous material contained in a carrier gas which is nondeleteriously reactive with respect to the products of pyrolysis, while simultaneously;

(b) introducing into the fast fluidized bed a pressurized particulate solid source of heat contained in a fluidizing carrier gas which is nondeleteriously reactive with respect to the products of pyrolysis through the perforations inclined to the path of flow of the carbonaceous material in the fast fluidized bed and at a velocity sufficient to prevent the carbonaceous material from caking on the wall and to penetrate and initiate pyrolysis of the carbonaceous material in the fast fluidized bed, the quantity of the particulate source of heat introduced being sufficient to raise the carbonaceous material to a pyrolysis temperature of at least about 600° F. to yield as products of pyrolysis pyrolytic vapor containing hydrocarbons and carbon containing solid residue;

(c) withdrawing a stream of a gaseous mixture of carrier gas and pyrolytic vapor entraining a solids mixture of particulate source of heat and carbon containing solid residue from the pyrolysis reaction zone through an outlet above the fast fluidized bed;

(d) separating the gaseous mixture from the solids mixture; and (e) recovering hydrocarbon values from the gaseous mixture.

2. The process of claim 1 in which the particulate solid source of heat and carrier gas are introduced at a pressure sufficient to form a pressure drop across the perforations from about 3 to about 7 psi.

3. The process of claim 1 in which the particulate source of heat exits the perforations at a velocity sufficient to penetrate at least halfway across the fluidized bed, but less than all the way across the entire fluidized bed.

4. The process of claim 1 in which the particulate source of heat includes char and exits the perforations at a velocity less than the velocity at which such char is pulverized by impinging against the perforated wall.

5. The process of claim 1 in which the particulate source of heat exits the perforations at a velocity from about 30 to about 70 feet per second.

6. The process of claim 1 in which the particulate solid source of heat is introduced to the fast fluidized bed along a path substantially normal to the path of travel of the carbonaceous material through the fast fluidized bed.

7. The process of claim 1 in which the weight ratio of particulate solid source of heat to carbonaceous material is from about 2:1 to about 20:1.

8. The process of claim 7 in which the particulate source of heat passes into the fast fluidized bed at a temperature from about 100° to about 500° F. above the pyrolysis temperature.

9. A process as claimed in claim 1 having a pyrolysis time of less than about 15 seconds.

10. The process of claim 1 in which the pyrolysis temperature is from about 900° to about 1400° F.

11. A process as claimed in claim 1 in which the particulate source of heat is introduced to the fast fluidized bed inclined at an angle from about 70° to about 90° to the path flow of the carbonaceous material in the fast fluidized bed.

12. A process for the pyrolysis of a carbonaceous material comprising the steps of:

(a) introducing to the base of a fast fluidized bed maintained within a vertically disposed perforated wall chamber of a pyrolysis reaction zone a flow of carbonaceous material contained in a carrier gas which is nondeleteriously reactive with respect to the products of pyrolysis, while simultaneously;

(b) introducing into a fluidizing chamber maintained along the outer periphery of the wall and communicating with the fast fluidized bed through the perforated wall, a particulate solid source of heat contained in a fluidizing gas which is nondeleteriously reactive with respect to the products of pyrolysis of the carbonaceous material, wherein the particulate solid source of heat is fluidized by the fluidizing gas and thereby passes through the perforations in the wall inclined to the path of travel of the carbonaceous material at a velocity sufficient to prevent the carbonaceous material from caking on the wall and to penetrate and initiate pyrolysis of the carbonaceous material to yield as products of pyrolysis within a pyrolysis time of less than about 15 seconds a pyrolytic vapor containing hydrocarbons and a particulate carbon containing solid residue, the introduced quantity of particulate source of heat being sufficient to raise the carbonaceous material to a pyrolysis temperature of at least about 600° F., while simultaneously;

(c) withdrawing a stream containing a gaseous mixture of the carrier gas and pyrolytic vapor entraining a solids mixture including particulate source of heat and carbon containing solids residue through an outlet above the fast fluidized bed;

(d) separating the gaseous mixture from the entrained solids mixture in a separation zone;

(e) recovering hydrocarbons from the gaseous mixture;

(f) collecting carbon containing solid residue not fluidizable in the fast fluidized bed in a stripping zone of the pyrolysis reaction zone;

(g) stripping hydrocarbons from particles in the stripping zone with a stripping gas which is nondeleteriously reactive with respect to pyrolysis products and which passes through the stripping zone into the fast fluidized bed; and (h) withdrawing stripped particles from the stripping zone.

13. The process of claim 12 in combination with the step of stripping hydrocarbons from the solids mixture separated in the separation zone.

14. The process of claim 12 in combination with the step of forming the particulate source of heat by at least partially oxidizing in a combustion zone the carbon containing solid residue resulting from pyrolysis of the carbonaceous material.

15. A process for the pyrolysis of an agglomerative coal comprising the steps of:

(a) introducing into the base of a vertically oriented fast fluidized bed maintained within a vertically disposed, perforated, cylindrical wall chamber of a pyrolysis reaction zone a flow of an agglomerative coal contained in a carrier gas which is nondeleteriously reactive with respect to pyrolysis products, while simultaneously;

(b) introducing into the fast fluidized bed through the perforations in the cylindrical wall a pressurized particulate solid source of heat comprising char contained in a fluidizing gas which is nondeleteriously reactive with respect to pyrolysis products, wherein the particulate solid source of heat passes through the perforations at an angle substantially normal to the flow path of the coal in the fast fluidized bed and at a velocity sufficient to prevent the carbonaceous material from caking on the wall and to penetrate and initiate pyrolysis of the carbonaceous material in the fast fluidized bed, the introduced quantity of the particulate source of heat being sufficient to raise the carbonaceous material to pyrolysis temperature of from about 600° to about 1600° F. to yield as products of pyrolysis within a pyrolysis time of less than about 15 seconds a particulate carbon containing solid residue containing char and a pyrolytic vapor including hydrocarbons, while simultaneously;

(c) withdrawing a stream containing a gaseous mixture of the carrier gas and pyrolytic vapor and an entrained solids mixture of the particulate solid source of heat and the carbon containing solid residue through an outlet above the fast fluidized bed; and (d) separating the gaseous mixture from the solids mixture in a separation zone.

16. The process of claim 15 in which the particulate source of heat exits the perforations at a velocity from about 50 to about 70 feet per second.

17. The process of claim 15 in which the particulate source of heat passes into the fast fluidized bed at a temperature from about 100° to about 500° F. above the pyrolysis temperature.

18. The process of claim 15 in which the particulate source of heat exits the perforations at a velocity greater than about 30 feet per second.

19. A reactor for pyrolysis of solid carbonaceous materials comprising:

(a) an inner chamber peripherally enclosed by a substantially vertically oriented perforated wall, the chamber having a solids inlet and a solids outlet at the base thereof and an outlet at the opposed end thereof;

(b) an outer chamber along at least a portion of the periphery of the perforated wall, the outer chamber having a solids inlet at the base thereof;

(c) means for introducing fluidized particulate carbonaceous material to undergo pyrolysis to the solids inlet of the inner chamber;

(d) means for introducing a stream of a particulate source of heat for pyrolysis of the carbonaceous material to the outer chamber and through the perforations of the vertically oriented perforated wall at a velocity sufficient to prevent the carbonaceous material from caking on the wall and to initiate pyrolysis of the carbonaceous material to yield a carbon containing solid residue; and (e) means for withdrawing carbon containing solid residue from the inner chamber through the solids outlet.

20. A reactor as claimed in claim 19 comprising in addition:

(a) a stripping chamber below the inner chamber for receiving solids from the inner chamber; and (b) an outlet for withdrawing stripped solids from the stripping chamber.

21. A reactor as claimed in claim 19 in which the perforations are substantially normal to the wall.

22. A reactor as claimed in claim 19 in which the outer chamber is along the entire periphery of the perforated wall.

23. A reactor for pyrolysis of solid carbonaceous materials comprising:

(a) an inner chamber peripherally enclosed by a perforated, substantially vertically oriented wall;

(b) an inlet for introducing fluidized particulate carbonaceous material to the base of the inner chamber;

(c) an outer chamber along the periphery of the perforated wall;

(d) an inlet for introducing a particulate source of heat to the base of the outer chamber;

(e) an inlet for introducing a fluidizing gas to the base of the outer chamber to carry particulate source of heat introduced to the outer chamber through the perforations in the perforated wall into the inner chamber at a velocity sufficient to prevent the carbonaceous material from agglomerating on the wall and to initiate pyrolysis of the carbonaceous material contained therein to yield as products of pyrolysis a particulate carbon containing solid residue and a pyrolytic vapor including hydrocarbons;

(f) outlet means above the inner chamber for removal of pyrolytic vapor and an entrained solids mixture including particulate source of heat and carbon containing solid residue; and (g) an outlet from the outer chamber for removal of carbon containing solid residue.

24. A reactor as claimed in claim 23 comprising in addition:

(a) a stripping chamber below the inner chamber and communicating with the inner chamber into which particulate carbon containing solid residue passes; and (b) means for passing a stripping gas through the stripping chamber.

25. The reactor of claim 23 in which the perforations are substantially normal to the wall.

26. The reactor of claim 23 in combination with:

(a) means for separating the pyrolytic vapor from the entrained solids mixture of particulate source of heat and carbon containing solid residue; and (b) connection means from the outlet at the top of the inner chamber to the separation means.

27. The reactor of claim 26 in combination with:

(a) means for stripping hydrocarbons from the entrained solid mixture separated by the separation means; and (b) means for transporting the solids mixture to the solids mixture stripping means from the separation means.

28. The reactor of claim 23 in which the outlet means above the inner chamber comprises a vertically oriented hood tapering inwardly away from the inner chamber.

29. A reactor for pyrolysis of coal comprising:

(a) an inner chamber peripherally enclosed by a perforated vertically oriented cylindrical tube;

(b) an inlet for introducing fluidized particulate coal to the base of the inner chamber;

(c) an outer chamber along the periphery of the perforated tube;

(d) an inlet for introducing a particulate source of heat to the base of the outer chamber;

(e) an inlet for introducing a fluidizing gas to the base of the outer chamber to carry the particulate source of heat introduced therein through the perforations of the perforated tube into the inner chamber at a velocity sufficient to prevent the coal contained therein from caking on the tube and to initiate pyrolysis of the coal contained therein to yield as products of pyrolysis a particulate carbon containing solid residue comprising char and a pyrolytic vapor including hydrocarbons;

(f) outlet means above the inner chamber for removal of pyrolytic vapor and an entrained solids mixture including particulate source of heat and a carbon containing solid residue;

(g) a stripping chamber below the inner chamber into which the carbon containing solid residue passes;

(h) means for passing a stripping gas through the stripping chamber and into the inner chamber;

(i) an outlet for withdrawing stripped particles from the stripping chamber;

(j) means for separating pyrolytic vapor from the entrained solid mixture of particulate source of heat and carbon containing solid residue;

(k) connection means from the outlet above the inner chamber to the separation means;

(l) a stripping chamber for stripping hydrocarbons from the entrained solids mixture separated by the separations means; and (m) means to transport the entrained solids mixture to the solids mixture stripping chamber from the separation means.

* * * * *